US011779045B2

(12) United States Patent
Gao et al.

(10) Patent No.: US 11,779,045 B2
(45) **Date of Patent: *Oct. 10, 2023**

(54) DISSOLVABLE-CHEWABLE EXHAUSTED-TOBACCO TABLET

(71) Applicant: ALTRIA CLIENT SERVICES LLC, Richmond, VA (US)

(72) Inventors: Feng Gao, Midlothian, VA (US); Diane L. Gee, Chesterfield, VA (US); Shuzhong Zhuang, Glen Allen, VA (US); Phillip M. Hulan, Midlothian, VA (US); William J. Burke, Nashville, TN (US)

(73) Assignee: Altria Client Services LLC, Richmond, VA (US)

( * ) Notice: Subject to any disclaimer, the term of this patent is extended or adjusted under 35 U.S.C. 154(b) by 1049 days.

This patent is subject to a terminal disclaimer.

(21) Appl. No.: 14/505,939

(22) Filed: Oct. 3, 2014

(65) Prior Publication Data

US 2015/0096576 A1 Apr. 9, 2015

Related U.S. Application Data

(60) Provisional application No. 61/886,367, filed on Oct. 3, 2013.

(51) Int. Cl.
*A24B 13/00* (2006.01)
*A24B 15/16* (2020.01)

(52) U.S. Cl.
CPC ..... *A24B 13/00* (2013.01); *A24B 15/16* (2013.01)

(58) Field of Classification Search
CPC ..... A24B 13/00; A24B 15/16
See application file for complete search history.

(56) References Cited

U.S. PATENT DOCUMENTS

| | | | | |
|---|---|---|---|---|
| 2,162,738 | A | 6/1939 | McCoy | |
| 3,139,436 | A | 6/1964 | Bicking | |
| 3,396,735 | A | 8/1968 | Bethmann et al. | |
| 4,153,063 | A | 5/1979 | Roselius et al. | |
| 4,448,208 | A | 5/1984 | Friedrich et al. | |
| 4,516,590 | A | 5/1985 | Teng | |
| 4,528,993 | A | 7/1985 | Sensabaugh et al. | |
| 4,647,459 | A | 3/1987 | Peters | |
| 4,660,577 | A | 4/1987 | Sensabaugh et al. | |
| 4,848,373 | A | 7/1989 | Lenkey | |
| 4,987,907 | A | 1/1991 | Townend | |
| 5,236,719 | A * | 8/1993 | Meyers | A23G 4/10 426/3 |
| 5,284,163 | A | 2/1994 | Knudsen et al. | |
| 5,372,149 | A | 12/1994 | Roth et al. | |
| 5,380,717 | A | 1/1995 | Ohkuma et al. | |
| 5,410,035 | A | 4/1995 | Wakabayashi et al. | |
| 5,487,792 | A | 1/1996 | King et al. | |
| 6,203,842 | B1 | 3/2001 | Reddy | |
| 7,798,151 | B2 | 9/2010 | Krukonis et al. | |
| 9,351,936 | B2 | 5/2016 | Gao | |
| 2004/0118422 | A1 | 6/2004 | Lundin et al. | |
| 2005/0053665 | A1 | 3/2005 | Ek et al. | |
| 2005/0178398 | A1 | 8/2005 | Breslin et al. | |
| 2005/0226925 | A1 | 10/2005 | Singh | |
| 2005/0244521 | A1 | 11/2005 | Strickland et al. | |
| 2006/0171994 | A1 | 8/2006 | Dupinay et al. | |
| 2007/0144544 | A1 | 6/2007 | Cai et al. | |
| 2008/0209586 | A1 | 8/2008 | Nielsen et al. | |
| 2009/0202635 | A1 * | 8/2009 | Scott | A61K 9/7007 424/464 |
| 2009/0293889 | A1 | 12/2009 | Kumar et al. | |
| 2010/0010101 | A1 | 1/2010 | Cherukuri | |
| 2010/0291245 | A1 * | 11/2010 | Gao | A24B 15/18 424/729 |
| 2011/0139164 | A1 | 6/2011 | Mua et al. | |
| 2011/0165253 | A1 | 7/2011 | Roehrich | |
| 2011/0200670 | A1 | 8/2011 | Thakkar | |
| 2012/0053108 | A1 | 3/2012 | Glenn, Jr. et al. | |
| 2012/0060854 | A1 | 3/2012 | Chen et al. | |
| 2013/0071476 | A1 * | 3/2013 | Cherukuri | A61K 9/2081 424/465 |

(Continued)

FOREIGN PATENT DOCUMENTS

| | | |
|---|---|---|
| DE | 19811167 | 6/1999 |
| EP | 2177213 | 4/2010 |

(Continued)

OTHER PUBLICATIONS

Tso (1999, Chapter 1 in Tobacco, Production, Chemistry and Technology, Davis & Nielsen, eds., Blackwell Publishing, Oxford).
Avaltroni et al., "Maltodextrin molecular weight distribution influemce on the glass transition tempurature and viscosity in aqueous solutions," Carbohyd Polymers 58:323-334, 2004.
Fitzpatrick et al., "Comparing the caking behaviours of skim milk powder, amorphous maltodextrin and crystalline common salt," Powder Technology 204(1):131-137, 2010.
Gonnissen et al., "Development of Directly Compressible Powders via Co-Spraying," Eur J Pharma Biopharma 67:220, 2007.
International Preliminary Report on Patentability in International Application No. PCT/US2014/059148, dated Apr. 14, 2016, 6 pages.
Patel et al., "Advances in oral transmucosal drug delivery," J Control Release 153(2):106-116, Jul. 30, 2011.
International Search Report and Written Opinion in International Application No. PCT/US2014/059148, dated Dec. 12, 2014, 9 pages.

(Continued)

*Primary Examiner* — Robert A Wax
*Assistant Examiner* — Olga V. Tcherkasskaya
(74) *Attorney, Agent, or Firm* — Harness, Dickey & Pierce, P.L.C.

(57) ABSTRACT

A exhausted-tobacco tablet that includes a solid solution of soluble fiber and one or more sugar alcohols, the solid solution having a glass transition temperature of less than 40° C., and exhausted-tobacco is dispersed in the solid solution, and one or more additives dispersed in the solid solution such that at least one additive is released from the tablet when the tablet is chewed or dissolved within an adult tobacco consumer's oral cavity.

12 Claims, 5 Drawing Sheets

(56) References Cited

U.S. PATENT DOCUMENTS

| | | | | |
|---|---|---|---|---|
| 2013/0118512 | A1* | 5/2013 | Jackson | A24B 13/00 131/355 |
| 2013/0186416 | A1* | 7/2013 | Gao | A24F 47/002 131/275 |
| 2013/0186417 | A1 | 7/2013 | Gao et al. | |
| 2013/0186418 | A1* | 7/2013 | Gao | A24B 13/00 131/275 |
| 2013/0260150 | A1 | 8/2013 | Duggins et al. | |
| 2015/0020818 | A1 | 1/2015 | Gao et al. | |

FOREIGN PATENT DOCUMENTS

| | | |
|---|---|---|
| WO | 2009/134947 | 11/2009 |
| WO | 2010/044736 | 4/2010 |

OTHER PUBLICATIONS

"Particle Size Conversion Table", by SIGMA-ALDRICH, 2 Pages, retrieved from the Internet Mar. 29, 2017 (www.sigmaaldrich.com).
"Definition of Lozenge", by Farlex in The Free Dictionary, 4 Pages, retrieved from the Internet Mar. 30, 2017 (www.thefreedictionary.com).
Definition of "Matrix", by Farlex in The Free Dictionary, 5 Pages, retrieved from the Internet on Oct. 11, 2017 (www.thefreedictionary.com).

* cited by examiner

110A

110B

110C

110D

110E

110F

DISSOLVABLE-CHEWABLE EXHAUSTED-TOBACCO TABLET

CROSS REFERENCE TO RELATED APPLICATIONS

This application claims the benefit of priority under 35 U.S.C. § 119(e) to U.S. Application No. 61/886,367 filed Oct. 3, 2013. The prior application is incorporated herein by reference in its entirety.

TECHNICAL FIELD

This document relates to dissolvable-chewable exhausted-tobacco tablets and methods for making dissolvable-chewable exhausted-tobacco tablets. For example, a dissolvable-chewable exhausted-tobacco tablet can include exhausted-tobacco fiber and nicotine within a solid solution of soluble fiber and one or more sugar alcohols

BACKGROUND

Tobacco can be enjoyed by adult tobacco consumers in a variety of forms. Smoking tobacco is combusted and the aerosol either tasted or inhaled (e.g., in a cigarette, cigar, or pipe). Smokeless tobacco products are not combusted and include: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between an adult tobacco consumer's cheek and gum. Snus is a heat treated smokeless tobacco. Dry snuff is finely ground tobacco that is placed in the mouth or used nasally.

SUMMARY

A dissolvable-chewable exhausted-tobacco tablet provided herein provides a satisfying tactile and/or flavor experience. A dissolvable-chewable exhausted-tobacco tablet provided herein is at least partially receivable in an oral cavity of an adult tobacco consumer. In some cases, a dissolvable-chewable exhausted-tobacco tablet provided herein is wholly receivable in an oral cavity. A dissolvable-chewable exhausted-tobacco tablet provided herein can include a solid solution of soluble fiber and one or more sugar alcohols with tobacco plant tissue dispersed therein. In some cases, a dissolvable-chewable exhausted-tobacco tablet provided herein can include unbound nicotine. In some cases, a dissolvable-chewable exhausted-tobacco tablet provided herein includes at least 20 weight percent of soluble fiber. In some cases, soluble fiber in dissolvable-chewable exhausted-tobacco tablet provided herein can include digestion-resistant maltodextrin. In some cases, a dissolvable-chewable exhausted-tobacco tablet provided herein includes at least 20 weight percent of one or more sugar alcohols. A dissolvable-chewable exhausted-tobacco tablet provided herein can be adapted to release exhausted-tobacco plant tissue therefrom when received within the oral cavity of an adult tobacco consumer and/or chewed by an adult tobacco consumer.

A dissolvable-chewable exhausted-tobacco tablet provided herein can, in some cases, include between 1 and 40 weight percent exhausted-tobacco fibers. In some cases, the tobacco used in the dissolvable-chewable exhausted-tobacco tobacco tablet includes between 5 and 35 weight percent exhausted-tobacco fibers. In some cases, the tobacco used in the dissolvable-chewable exhausted-tobacco tobacco tablet includes between 10 and 30 weight percent exhausted-tobacco fibers. In some cases, the tobacco used in the dissolvable-chewable exhausted-tobacco tobacco tablet includes between 15 and 25 weight percent exhausted-tobacco fibers. In some cases, the tobacco used in the dissolvable-chewable exhausted-tobacco tobacco tablet includes between 1 and 10 weight percent exhausted-tobacco fibers. In some cases, exhausted-tobacco fibers used in a dissolvable-chewable exhausted-tobacco tablet provided herein can be processed to have an average fiber length of less than 200 micrometers, less than 150 micrometers, less than 125 micrometers, less than 100 micrometers, less than 75 micrometers, less than 50 micrometers, less than 25 micrometers, less than 20 micrometers, or less than 10 micrometers. In some cases, exhausted-tobacco fibers used in a dissolvable-chewable exhausted-tobacco tablet provided herein can be processed to have an average fiber length of at least 1 micrometer, at least 5 micrometers, at least 10 micrometers, at least 25 micrometers, at least 50 micrometers, at least 75 micrometers, at least 100 micrometers, at least 125 micrometers, or at least 150 micrometers. In some cases, exhausted-tobacco fibers used in a dissolvable-chewable exhausted-tobacco tablet provided herein can be processed to have an average fiber length of between 25 and 125 micrometers. A solid solution of soluble fiber and one or more sugar alcohols provided herein can have a glass transition temperature selected to provide a stable product at ambient temperatures, but that is chewable at body temperature. For example, by using the relatively high soluble fiber content, the glass transition temperature of a dissolvable-chewable exhausted-tobacco tablet provided herein can be selected such that it is relatively close to ambient temperature, which can permit an adult tobacco consumer to experience an enjoyable tactile experience (e.g., mouth feel). A dissolvable-chewable exhausted-tobacco tablet provided herein can include a single and continuous phase of the solid solution and dispersed additives (e.g., oil, cellulosic fiber, nicotine) particles of tobacco. At ambient temperatures, the solid solution can be amorphous and glassy.

A method of making dissolvable-chewable exhausted-tobacco tablets provided herein includes forming a molten mixture of at least 20 weight percent soluble fiber, at least 20 weight percent of one or more sugar alcohols, exhausted-tobacco fibers, one or more additives (e.g., nicotine or a derivative thereof), and less than 15 weight percent water, while maintaining a mixture temperature of less than 150° C., and portioning the molten mixture into a plurality of dissolvable-chewable exhausted-tobacco tablets. In some cases, the ingredients can be mixed to form the molten mixture in an extruder and individual dissolvable-chewable exhausted-tobacco tablets formed from the molten mixture as it leaves the extruder. Plasticizers, such as oil, can be added to the molten mixture (e.g., in an extruder). In some cases, oil is added to increase the chewiness of a dissolvable-chewable exhausted-tobacco tablet provided herein. In some cases, oil can be added to a molten mixture to cool the molten mixture to a temperature such that the molten mixture becomes a solid solution having some shape stability.

Unlike a traditional cooking process where sugars or sugar alcohols are heated to a temperature such that caramelization and other cross-linking occurs, methods provided herein include a controlled mixing and heating of soluble fiber and sugar alcohols to form a molten mixture and dispersing nicotine (and optionally other ingredients) in the solid solution without creating significant crosslinking of the sugar alcohols. Because exhausted-tobacco fibers certain additives (e.g., nicotine) can degrade when exposed to temperatures in excess of 150° C., a temperature of a molten mixture provided herein can be maintained at a temperature of 150° C. or below during a mixing process. In some cases, a molten mixture provided herein is heated to a maximum temperature of between 80° C. and 150° C. In some cases, a molten mixture provided herein is heated to a temperature of between 100° C. and 110° C. When cooled ambient temperatures, a molten mixture provided herein solidifies into an amorphous, non-porous, glassy, body consisting of a single and continuous phase of the solid solution and dispersed additives (e.g., oil, exhausted-tobacco fibers). Because the soluble fibers and sugar alcohols do not become cross-linked, they can remain soluble and thus dissolve when placed in an adult tobacco consumer's mouth.

In some cases, a dissolvable-chewable exhausted-tobacco tablet provided herein can include a digestion-resistant soluble fiber. In some cases, a dissolvable-chewable exhausted-tobacco tablet provided herein can include a digestion-resistant maltodextrin derived from maze. For example, Fibersol®-2 is a digestion-resistant corn-derived maltodextrin soluble fiber, which can be used as the soluble fiber in a dissolvable-chewable exhausted-tobacco tablet provided herein. Other starch sources such as potato, rice, wheat, barley, peas, beans, lentils, oats, or tapioca can be processed to form digestion-resistant soluble fiber. A digestion resistant soluble fiber can include starch linkages that remain undigested by enzymes of the human digestive tract. Soluble fiber used in a dissolvable-chewable exhausted-tobacco tablet provided herein can be a soluble fiber generally recognized as safe ("GRAS") by the Food and Drug Administration or another appropriate private, state, or national regulatory agency.

In some cases, a dissolvable-chewable exhausted-tobacco tablet provided herein can include one or more sugar alcohols selected from the following group: mannitol, sorbitol, xylitol, erythritol, isomalt, lactitol, maltitol, maltitol syrup, and hydrogenated starch hydrolysates [HSH]. In some cases, a dissolvable-chewable exhausted-tobacco tablet provided herein can include two or more sugar alcohols. In some cases, a dissolvable-chewable exhausted-tobacco tablet provided herein can include mannitol and sorbitol. Sugar alcohols used in a dissolvable-chewable exhausted-tobacco tablet provided herein can be generally recognized as safe ("GRAS") by the Food and Drug Administration or another appropriate private, state, or national regulatory agency.

A dissolvable-chewable exhausted-tobacco tablet provided herein can, in some cases, include up to 15 weight percent water. In some cases, a dissolvable-chewable exhausted-tobacco tablet provided herein can include between 0.5 weight percent and 7 weight percent water. In some cases, a dissolvable-chewable exhausted-tobacco tablet provided herein can include between 1 weight percent and 5 weight percent water. In some cases, a dissolvable-chewable exhausted-tobacco tablet provided herein can include between 2 weight percent and 4 weight percent water.

In some cases, nicotine or a derivative thereof can be included in a dissolvable-chewable exhausted-tobacco tablet provided herein. Nicotine or derivatives thereof added to a dissolvable-chewable exhausted-tobacco tablet provided herein can be in any suitable form. In some cases, a dissolvable-chewable exhausted-tobacco tablet provided herein includes between 0.1 mg and 20 mg nicotine. In some cases, a dissolvable-chewable exhausted-tobacco tablet provided herein includes between 0.5 mg and 10 mg nicotine. In some cases, a dissolvable-chewable exhausted-tobacco tablet provided herein includes between 1.0 mg and 6 mg nicotine. In some cases, a dissolvable-chewable exhausted-tobacco tablet provided herein includes between 1.0 mg and 3.0 mg nicotine. In some cases, nicotine in a dissolvable-chewable exhausted-tobacco tablet provided herein includes tobacco-derived nicotine. In some cases, nicotine in a dissolvable-chewable exhausted-tobacco tablet provided herein includes synthetic nicotine. In some cases, liquid nicotine can be absorbed into exhausted-tobacco fibers and/or additional cellulose fibers. Combining liquid nicotine with cellulosic fiber (such as exhausted-tobacco fibers) can provide stabilized nicotine such that can be added to a dissolvable-chewable exhausted-tobacco tablet provided herein in a method provided herein. In some cases, liquid nicotine is added to exhausted-tobacco fibers prior to mixing the exhausted-tobacco fibers and nicotine into a mixture of soluble fiber and one or more sugar alcohols.

A dissolvable-chewable exhausted-tobacco tablet provided herein can include a sweetener dispersed therein. Suitable sweeteners include saccharine, sucralose, aspartame, acesulfame potassium, and combinations thereof. In some cases, a dissolvable-chewable exhausted-tobacco tablet provided herein can be substantially free of sugars. For example, a dissolvable-chewable exhausted-tobacco tablet can be substantially free of sugars, but include one or more sugar alcohols and non-nutritive sweeteners. In some cases, a dissolvable-chewable exhausted-tobacco tablet provided herein can include non-caramelized sugars in a percentage of no more than 25 weight percent.

A dissolvable-chewable exhausted-tobacco tablet provided herein can include flavorants. The flavorants can be natural or artificial. Flavorants can be selected from the following: licorice, wintergreen, cherry and berry type flavorants, Drambuie, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang ylang, sage, fennel, pimenta, ginger, anise, chai, coriander, coffee, mint oils from a species of the genus *Mentha*, cocoa, and combinations thereof. Synthetic flavorants can also be used. In some cases, a combination of flavorants can be combined to imitate a tobacco flavor. The particular combination of flavorants can be selected from flavorants that are GRAS in a particular country, such as the United States. Flavorants can also be included in the dissolvable-chewable exhausted-tobacco tablet as encapsulated flavorants.

A dissolvable-chewable exhausted-tobacco tablet provided herein can include a plasticizer dispersed in the solid solution. For example, the plasticizer can be propylene glycol, glycerin, vegetable oil, triglycerides, or a combination thereof. Plasticizers can be added as processing aids and/or to make a dissolvable-chewable exhausted-tobacco tablet chewier. In some cases, oil can be added to a molten mixture including sugar alcohol(s), soluble fibers, and nicotine to cool the molten mixture. In some cases, a dissolvable-chewable exhausted-tobacco tablet provided herein can include oil dispersed within a matrix of a solid solution provided herein.

A body of a dissolvable-chewable exhausted-tobacco tablet provided herein can have a variety of different shapes, some of which include disk, shield, heart, rectangle, and square. In some cases, a body of a dissolvable-chewable exhausted-tobacco tablet provided herein can have rounded corners. In some cases, the body of the dissolvable-chewable exhausted-tobacco tablet can be spherical. According to certain embodiments, the body can have a length or width of between 1 mm and 25 mm and a thickness of between 1 mm and 25 mm. In some cases, the body can have a length or width of between 5 mm and 15 mm and a thickness of between 2 mm and 5 mm. In some cases, a dissolvable-chewable exhausted-tobacco tablet provided herein can include a colorant. For example, a body of a dissolvable-chewable exhausted-tobacco tablet provided herein can include titanium dioxide, which can provide the body with a white color. In some cases, a coating on the body can include a colorant.

A method of forming dissolvable-chewable exhausted-tobacco tablets can include forming a molten mixture of at least 20 weight percent soluble fiber, at least 20 weight percent of one or more sugar alcohols, exhausted-tobacco fibers, and one or more additives (e.g., nicotine), and less than 15 weight percent water, while maintaining a mixture temperature of less than 150° C. In some cases, the molten mixture includes at less than 13 weight percent, less than 10 weight percent, less than 8 weight percent, less than 7 weight percent, less than 6 weight percent, or less than 5 weight percent water. In some cases, the molten mixture includes at least 0.5 weight percent, at least 1 weight percent, at least 2 weight percent, or at least 3 weight percent water. In addition to exhausted-tobacco, nicotine, water, sugar alcohol(s) and soluble fiber (e.g., maltodextrin), a molten mixture provided herein can include one or more additives selected from colorants, sweeteners, flavorants, plasticizers, antioxidants, processing aids, and combinations thereof. In some cases, the molten mixture is substantially free of sugars.

In some cases, the molten mixture provided herein is formed in an extruder. The extruder can be a multi-staged extruder having different sections that are heated to different temperatures and/or have different ingredients introduced. In some cases, an extruder provided herein can include multiple stages and can be used in a method provided herein in a process where the maximum temperature in any stage is no more than 150° C. (e.g., no more than 120° C., no more than 110° C., or no more than 105° C.). Portioning the molten mixture provided herein can be accomplished using any suitable method. A method provided herein can further include cooling dissolvable-chewable exhausted-tobacco tablets and packaging dissolvable-chewable exhausted-tobacco tablets.

The details of one or more embodiments of the subject matter described in this specification are set forth in the accompanying drawings and the description below. Other features, aspects, and advantages of the subject matter will become apparent from the description, the drawings, and the claims.

DETAILED DESCRIPTION

Figure 1:
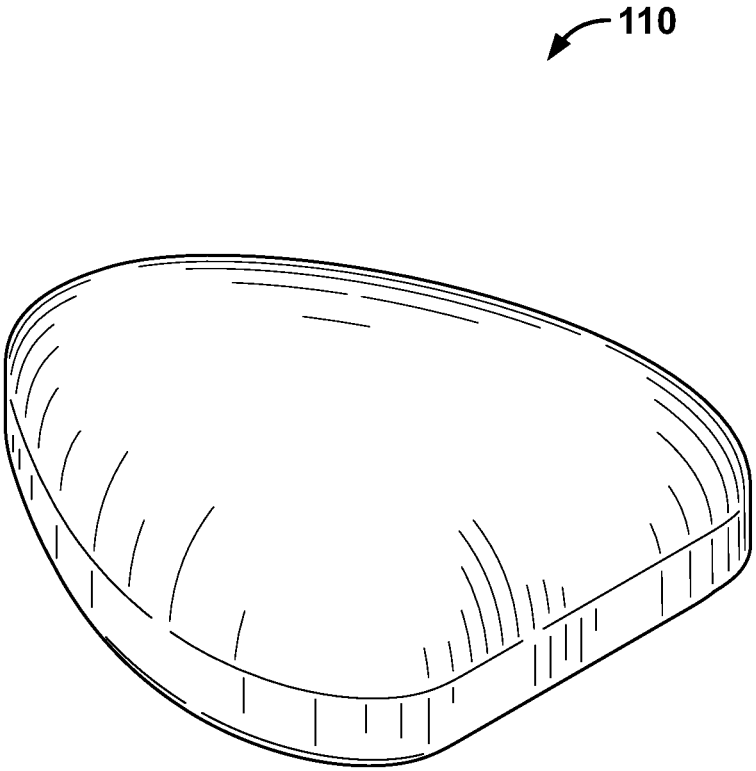
FIG. 1 is a perspective view of a dissolvable-chewable exhausted-tobacco tablet provided herein.

The dissolvable-chewable exhausted-tobacco tablets described herein include a solid solution of soluble fiber and one or more sugar alcohols. Nicotine or a derivative thereof (and optionally additional additives) can be dispersed in the solid solution such that the one or more additives are released from the dissolvable-chewable exhausted-tobacco tablet when the dissolvable-chewable exhausted-tobacco tablet is chewed and/or dissolved within an oral cavity. The dissolvable-chewable exhausted-tobacco tablets described herein can provide a favorable additive release profile and tactile experience. In some cases, a dissolvable-chewable exhausted-tobacco tablet provided herein includes unbound nicotine in the solid solution and/or absorbed into cellulosic fibers dispersed in a matrix of the solid solution. As used herein, the term "tobacco plant tissue" refers to processed or non-processed cellulosic parts (e.g., leaves, stems) of a member of the genus *Nicotiana*, but does not include extracts of tobacco (e.g., tobacco-derived nicotine).

Unlike traditional cooking processes, which typically solidify the ingredients by heating the ingredients to a temperature such that sugars and/or sugar alcohols caramelize, dissolvable-chewable exhausted-tobacco tablets provided herein can be made by forming a solid solution of soluble fiber and one or more sugar alcohols in a controlled heating and mixing process maintained at a temperature of 150° C. or below. The solid solutions described herein exhibit a glass transition temperature (Tg) in the range of −75° C. to 40° C. Because exhausted-tobacco degradation can be accelerated when exposed to elevated temperatures over extended periods of time, the temperature of a molten mixture provided herein can be maintained at a temperature of 150° C. or below over a residence time of five to ten minutes or less during the mixing (for example, if an extrusion process is utilized). In some cases, an extruder can be used for this controlled heating and mixing process. A desired texture of the chewable dissolvable tablet can be determined by the selection and weight percentages of the soluble fiber and sugar alcohol(s) and the mixing process conditions. In some cases, a dissolvable-chewable exhausted-tobacco tablet provided herein can include maltodextrin as the soluble fiber. In some cases, a dissolvable-chewable exhausted-tobacco tablet provided herein can include at least 20 weight percent maltodextrin. In some cases, the soluble fiber can be digestion resistant soluble fiber (e.g., digestion resistant maltodextrin such as Fibersol®-2). By changing the ratio of soluble fiber to sugar alcohols, the Tg of the mixture can be altered and therefore the desired final texture of the product. In some cases, plasticizers can be incorporated into a dissolvable-chewable exhausted-tobacco tablet provided herein to make it more chewable.

In addition to exhausted-tobacco, one or more additional additives can be included in a dissolvable-chewable exhausted-tobacco tablet provided herein and adapted to be released from the dissolvable-chewable exhausted-tobacco tablet when the dissolvable-chewable exhausted-tobacco tablet is placed in an oral cavity and chewed by an adult tobacco consumer. In some cases, a dissolvable-chewable exhausted-tobacco tablet provided herein can include a combination of nicotine and/or derivatives thereof, sweeteners, and flavorants to mimic the flavor profile and tactile experience of certain tobacco products.

A dissolvable-chewable exhausted-tobacco tablet provided herein can take up to 4 hours, up to 3 hours, up to 2 hours, or up to 1 hour to dissolve when placed in an adult tobacco consumer's mouth. Chewing can increase the rate of dissolution. In some cases, a dissolvable-chewable exhausted-tobacco tablet provided herein can take between 1 minute and 30 minutes to dissolve when chewed in an adult tobacco consumer's mouth. In some cases, a dissolvable-chewable exhausted-tobacco tablet provided herein can take between 2 minutes and 15 minutes to dissolve when chewed in an adult tobacco consumer's mouth.

In addition to additives, sweeteners, and flavorants, a dissolvable-chewable exhausted-tobacco tablet provided herein can also include cellulosic fibers, fillers, plasticizers, and/or processing aids. Cellulosic fibers can at least partially absorb nicotine and/or other additives (e.g., sweeteners and/or flavorants). Fillers can also be included in the solid solution to alter the texture or pliability of the dissolvable-chewable exhausted-tobacco tablet. The solid solution can also include plasticizers, which can increase the softness and/or chewability of the dissolvable-chewable exhausted-tobacco tablet. Processing aids can also be present in the dissolvable-chewable exhausted-tobacco tablet and be used to facilitate shaping processes.

Dissolvable-Chewable Exhausted-Tobacco Tablet Shapes and Packaging

FIG. 1 depicts an example of a dissolvable-chewable exhausted-tobacco tablet 110. Dissolvable-chewable exhausted-tobacco tablet 110 has a shield shape. For example, dissolvable-chewable exhausted-tobacco tablet 110 can have a length of about 16 mm, width of about 14 mm and a thickness of about 9 mm.

Figure 1A:
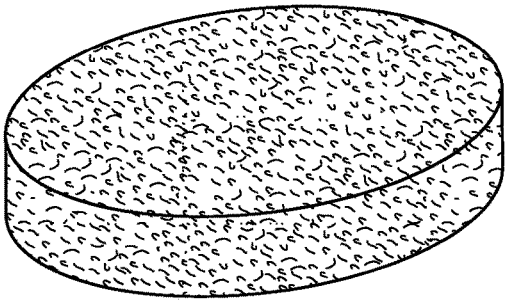
FIGS. 1A-1O illustrates various additional exemplary shapes of dissolvable-chewable exhausted-tobacco tablets provided herein.
Figure 1B:
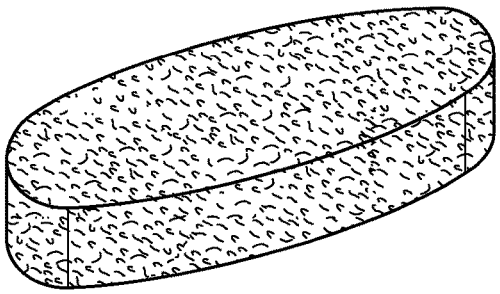
Figure 1C:
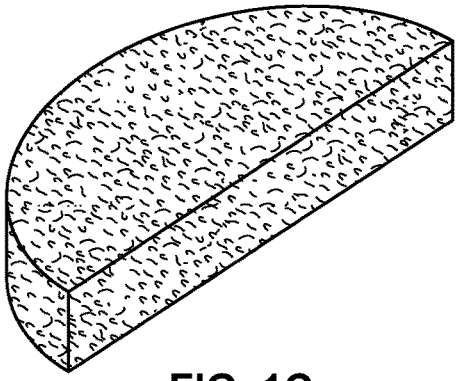
Figure 1D:
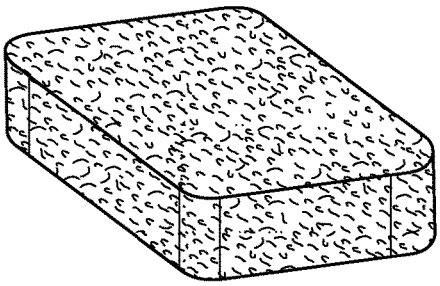
Figure 1E:
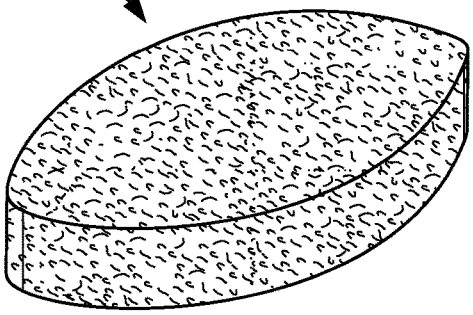
Figure 1F:
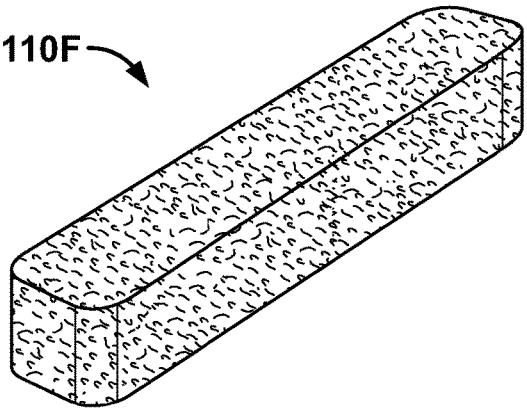
Figure 1G:
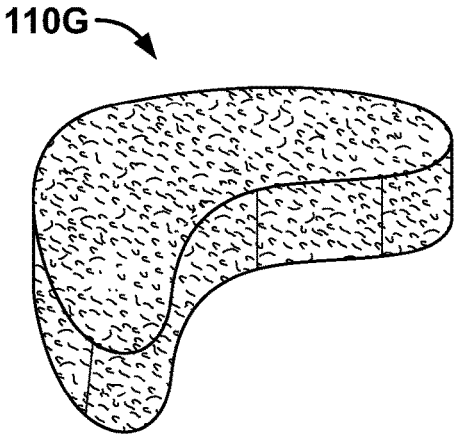
Figure 1H:
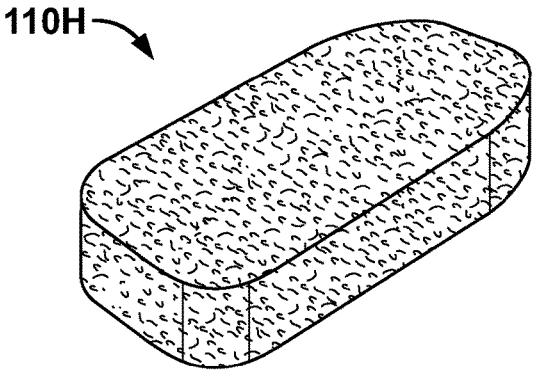
Figure 1I:
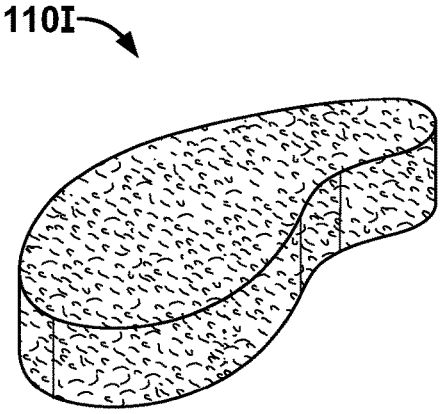
Figure 1J:
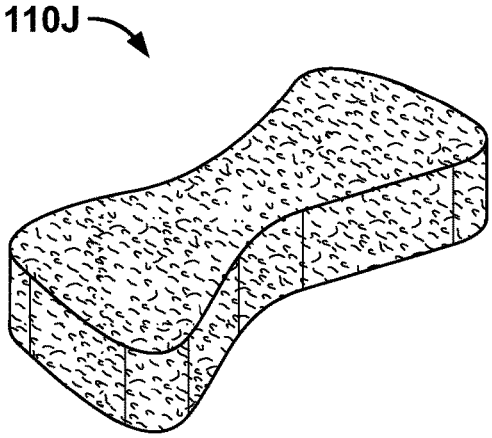
Figure 1K:
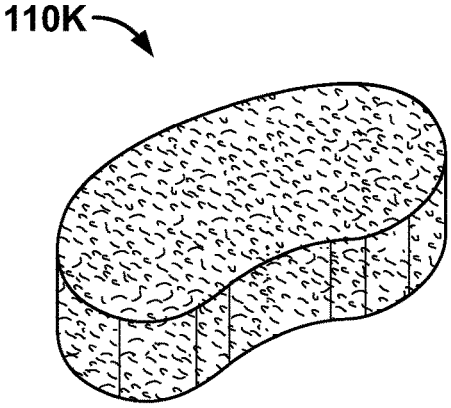
Figure 1L:
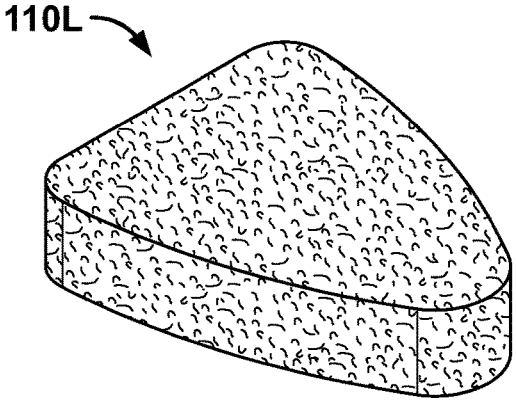
Figure 1M:
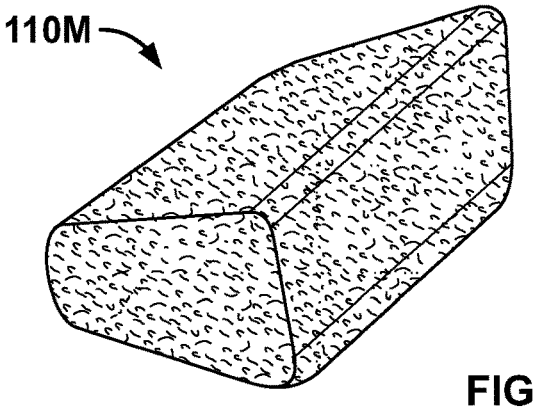
Figure 1N:
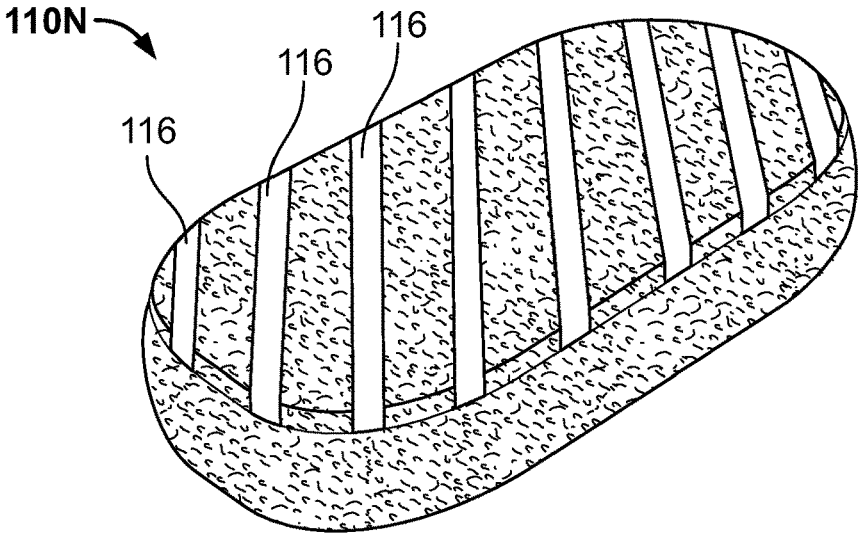

Referring now to FIGS. 1A-1N, dissolvable-chewable exhausted-tobacco tablets provided herein can be molded into any desired shape. For example, referring to FIGS. 1A-1L, dissolvable-chewable exhausted-tobacco tablets 110A-L can be formed in shapes that promotes improved positioning in the oral cavity, improved packaging characteristics, or both. In some circumstances, dissolvable-chewable exhausted-tobacco tablets 110A-L can be configured to be: (A) an elliptical-shaped dissolvable-chewable exhausted-tobacco tablet 110A; (B) an elongated elliptical-shaped dissolvable-chewable exhausted-tobacco tablet 110B; (C) semi-circular dissolvable-chewable exhausted-tobacco tablet 110C; (D) square or rectangular-shaped dissolvable-chewable exhausted-tobacco tablet 110D; (E) football-shaped dissolvable-chewable exhausted-tobacco tablet 110E; (F) elongated rectangular-shaped dissolvable-chewable exhausted-tobacco tablet 110F; (G) boomerang-shaped dissolvable-chewable exhausted-tobacco tablet 110G; (H) rounded-edge rectangular-shaped dissolvable-chewable exhausted-tobacco tablet 110H; (I) teardrop- or comma-shaped dissolvable-chewable exhausted-tobacco tablet 110I; (J) bowtie-shaped dissolvable-chewable exhausted-tobacco tablet 110J; (K) peanut-shaped dissolvable-chewable exhausted-tobacco tablet 110K; and (L) shield-shaped dissolvable-chewable exhausted-tobacco tablet. Alternatively, the dissolvable-chewable exhausted-tobacco tablet can have different thicknesses or dimensionality, such that a beveled article (e.g., a wedge) is produced (see, for example, product 110M depicted in FIG. 1M) or a hemi-spherical shape is produced. In some cases, dissolvable-chewable exhausted-tobacco tablets provided herein have a shield shape.

In addition or in the alternative to flavorants being included within the soluble fiber matrix, flavorants can be included on an exterior of the dissolvable-chewable exhausted-tobacco tablet 110. For example, referring to FIG. 1N some embodiments of a dissolvable-chewable exhausted-tobacco tablet 110N can be equipped with flavor strips 116.

Figure 1O:
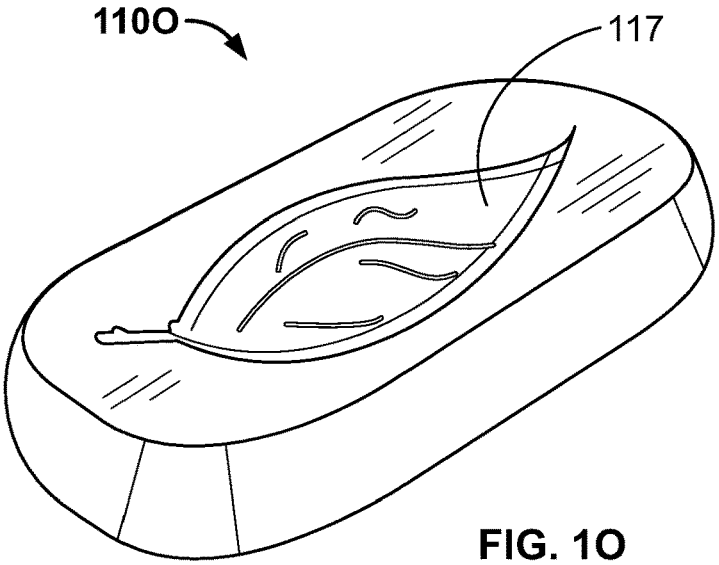

Referring to FIG. 1O, particular embodiments of the dissolvable-chewable exhausted-tobacco tablet 110 can be embossed or stamped with a design (e.g., a logo, an image, or the like). For example, a dissolvable-chewable exhausted-tobacco tablet 110O, such as shown in FIG. 1O, can be embossed or stamped with any type of design 117 including, but not limited to, a trademark, a product name, or any type of image. The design 117 can be formed directly into the dissolvable-chewable exhausted-tobacco tablet, arranged along the exterior of the product 110O. The design 117 can also be embossed or stamped into those embodiments with a dissolvable film 116 applied thereto.

In some cases, a dissolvable-chewable exhausted-tobacco tablet 110 can be wrapped or coated in an edible or dissolvable film, which may be opaque, substantially transparent, or translucent. The dissolvable film can readily dissipate when the dissolvable-chewable exhausted-tobacco tablet 110 is placed in an oral cavity. In some cases, the dissolvable-chewable exhausted-tobacco tablet 110 can be coated with a mouth-soluble material. Exemplary coating materials include Carnuba wax, Beeswax, gelatin, acetylated monoglyceride, starch (e.g., native potato starch, high amylose starch, and hydroxypropylated potato starch), Zein, Shellac, ethyl cellulose, methylcellulose, hydroxypropyl methylcellulose, carboxymethyl cellulose, and combinations thereof. Additives, such as miglycol, titanium dioxide, kaoline, bentonite, can be incorporated into the coating material to improve oxygen or moisture barrier and mechanical properties for the coating or film. For example, a coating can include a combination of gelatin, methylcellulose or gelatin and hydroxymethylcellulose. In some cases, the coating can contain sugar alcohols such as sorbitol, mannitol, xylitol, erythritol), disaccharide-derived (e.g., isomalt, lactitol, maltitol), or polysaccharide-derived mixtures (e.g., maltitol syrup, hydrogenated starch hydrolysates [HSH]) or combinations thereof. In some cases a coating material can contain sugar alcohols and hydroxymethylcellulose, gelatin, wax, with additives. In some cases, a coating material can include a plasticizer. In some cases, a coating can include a colorant, a flavorant, and/or a one or more of the additives discussed above. For example, a coating can include nicotine to provide a user with readily available nicotine. In some cases, the solid solution can form a body that can have surfaces roughened to improve the adherence of a coating. In some cases, a coating can provide a glossy or semi-glossy appearance, a smooth surface, and/or an appealing visual aesthetic (e.g., a nice color). In some cases, the coating (e.g., a Beeswax, Carnuba wax, Zein, acetylated monoglyceride, and/or hydroxypropylated potato starch coating) can provide a soft mouth feel. In some cases, the coating (e.g., a methylcellulose, hydroxypropyl methylcellulose, carboxymethyl cellulose, ethyl cellulose, and/or gelatin coating) can provide a hard outer coating.

One or more dissolvable-chewable exhausted-tobacco tablets 110 can be packaged in a variety of conventional and non-conventional manners. For example, a plurality of dissolvable-chewable exhausted-tobacco tablets 110 can be packaged in a container having a lid. In some cases, a plurality of dissolvable-chewable exhausted-tobacco tablets 110 can be stacked and packaged in a paper, plastic, and/or aluminum foil tube. The packaging can have a child-resistant lid.

Dissolvable-Chewable Exhausted-Tobacco Tablet Properties

Dissolvable-chewable exhausted-tobacco tablets provided herein can provide a favorable tactile experience (e.g., mouth feel). While dissolvable-chewable exhausted-tobacco tablets can retain its shape during processing, shipping, handling, dissolvable-chewable exhausted-tobacco tablets provided herein include a solid solution that dissolves or disintegrates when the dissolvable-chewable exhausted-tobacco tablet 110 is placed in an oral cavity, exposed to saliva, and/or chewed. Prior to dissolution or disintegration in an oral cavity, dissolvable-chewable exhausted-tobacco tablet provided herein can undergo a phase transition from a glassy state to a rubbery state then finally into to a viscous state. To further promote a favorable tactile experience (e.g., mouth feel), in some cases, dissolvable-chewable exhausted-tobacco tablet 110 can be formulated to exhibit a smooth texture. Working of the dissolvable-chewable exhausted-tobacco tablet 110 within the oral cavity can accelerate the release of the nicotine within the solid solution.

During use, the environment surrounding the dissolvable-chewable exhausted-tobacco tablet 110 transitions from room temperature (e.g., ~25° C.) to body temperature (e.g., ~37° C.). One way of characterizing the properties of the dissolvable-chewable exhausted-tobacco tablet 110 is by determining the phase transition points of the dissolvable-chewable exhausted-tobacco tablet using differential scanning calorimetry (DSC). The dissolvable-chewable exhausted-tobacco tablet 110 is composed of various ingredients, therefore, the thermal transitions of the dissolvable-chewable exhausted-tobacco tablet can differ not only due to the individual properties of each ingredient, but also due to the ratios of those ingredients. For example, the thermal transitions of a dissolvable-chewable exhausted-tobacco tablet with approximately 30-40 weight percent of maltodextrin, a mixture of mannitol and sorbitol of approximately 30-40 weight percent, and a water content from 0.5 weight percent to 7 weight percent. In some cases, a glass transition temperature ($T_g$) 202 of the dissolvable-chewable exhausted-tobacco tablet 110 can be from −65° C. to 60° C. (e.g., −50° C. to 40° C., −40° C. to 30° C., −30° C. to 20° C., −20° C. to 10° C., and −10° C. to 0° C.). The approximate $T_g$ of this formulation can be from −20 to 10° C. Thus, at room temperature the dissolvable-chewable exhausted-tobacco tablet 110 is at the end of the transition from a glassy state to a rubbery/viscous state. Once the dissolvable-chewable exhausted-tobacco tablet 110 is placed in an oral cavity at body temperature, the dissolvable-chewable exhausted-tobacco tablet 110 can complete the phase transition to a rubbery/viscous state. In particular embodiments, the dissolvable-chewable exhausted-tobacco tablet 110 is coated to facilitate bulk packaging.

In some cases, the melting transition point (Tm) of the oil dispersed in the dissolvable chewable exhausted-tobacco tablet 110 is 28° C. (82.4° F.). As the dissolvable-chewable exhausted-tobacco tablet 110 is exposed to body temperature that exceeds the Tm of the oil, the oil undergoes a phase transition to a liquid state. This transition can provide a favorable tactile experience (e.g., mouth feel) to the user as it causes the dissolvable tobacco tablet to soften. The mixture of mannitol, sorbitol and maltodextrin can be amorphous for the example shown in. Therefore the product does not have "crumbly" texture in the chewable product. The multiple phases in the dissolvable tobacco tablet are visible through x-ray microtomography. A soluble fiber, sugar alcohol, and tobacco mixture appears as a dense matrix domain, while the oil is partitioned in oil domains.

The dissolvable-chewable exhausted-tobacco tablet 110 can have a variety of colors. In some cases, the dissolvable-chewable exhausted-tobacco tablet 110 has an off-white color. For example, titanium dioxide (TiO2) can be added to the exhausted-tobacco, soluble fiber, sugar alcohol blend, and cellulose fiber mixture. Any dark voids dispersed throughout the dense matrix can indicate pockets of oil, flavor, and/or nicotine. In some cases, natural and artificial coloring can be added to a molten mixture that forms the solid solution during a molding process to form dissolvable-chewable exhausted-tobacco tablets 110 having a predetermined color. Encapsulated flavors can be added during the extrusion process to create speckles, patterns, or dots within a dissolvable-chewable exhausted-tobacco tablet.

Soluble Fiber

Soluble fiber dissolves in ambient water. Insoluble fiber does not dissolve in ambient water. Soluble fibers can attract water and form a gel. Not only are many soluble fibers safe for consumption, but some soluble fibers are used as a dietary supplement. Instead of using soluble fiber as a mere additive, however, dissolvable-chewable exhausted-tobacco tablets provided herein include a solid solution of soluble fiber and sugar alcohols that can be combined with nicotine (and optionally other additives) to provide a satisfying tactile and/or flavor experience.

Any suitable soluble fiber or combination of soluble fibers can be used to form a soluble-fiber solution provided herein. Suitable soluble fibers include maltodextrin, psyllium, pectin, guar gum, gum arabic, inulin, arabinoxylans, cellulose, and many other plant components such as resistant starch, resistant dextrins, lignin, pectins, beta-glucans, and oligosaccharides or a combination thereof. In some cases, an exhausted-tobacco tablet provided herein can include a digestion-resistant soluble fiber. A digestion resistant soluble fiber can include starch linkages that remain undigested by enzymes of the human digestive tract. In some cases, an exhausted-tobacco tablet provided herein can include a digestion-resistant maltodextrin. In some cases, a digestion-resistant maltodextrin can be derived from maze. Suitable maltodextrins can include those that are soluble in water up to 70% at 20° C., have a viscosity of about 15 cps for a 30% solution at 30° C., a DE in the range of about 6-16, and contain random α-1,2, α-1,3, α-1,4, β-1,2, β-1,3 and β-1,4 glucose linkages in addition to the normal α-1,4 glucose linkages found in partially hydrolyzed starch. See, e.g., U.S. Pat. Nos. 5,410,035; 5,380,717, which are hereby incorporated by reference. For example, Fibersol®-2 is a maltodextrin of DE 6-10 processed from corn starch using hydrochloric acid and enzymes, which can be used as the soluble fiber in an exhausted-tobacco tablet provided herein. Fibersol®-2 is partially indigestible because human digestive enzymes are incapable of digesting β 1,2, β 1,3 and β 1,6 glucose bonds. See, e.g., U.S. Pat. No. 6,203,842, which is hereby incorporated by reference. Other starch sources such as potato, rice, wheat, barley, peas, beans, lentils, oats, or tapioca can be processed to form digestion-resistant soluble fiber. A digestion resistant soluble fiber includes starch linkages that cannot be hydrolyzed by enzymes of the human digestive tract. In some cases, suitable soluble fibers include Pinefibre, Pinefibre C, Dexflow and Pineflow as discussed in U.S. Pat. No. 5,236,719, which is hereby incorporated by reference. Soluble fiber used in an exhausted-tobacco tablet provided herein can be GRAS by the Food and Drug Administration or another appropriate private, state, or national regulatory agency.

A dissolvable-chewable exhausted-tobacco tablet provided herein can include at least 20 weight percent of soluble fiber, at least 25 weight percent of soluble fiber, at least 30 weight percent of soluble fiber, at least 35 weight percent of soluble fiber, at least 40 weight percent of soluble fiber, at least 45 weight percent of soluble fiber, at least 50 weight percent of soluble fiber, or at least 55 weight percent of soluble fiber. In some cases, a dissolvable-chewable exhausted-tobacco tablet provided herein can include at least 20 weight percent maltodextrin, at least 25 weight percent maltodextrin, at least 30 weight percent maltodextrin, at least 35 weight percent maltodextrin, at least 40 weight percent maltodextrin, at least 45 weight percent maltodextrin, at least 50 weight percent maltodextrin, or at least 55 weight percent maltodextrin. In some cases, a dissolvable-chewable exhausted-tobacco tablet provided herein can include less than 70 weight percent maltodextrin, less than 60 weight percent maltodextrin, less than 50 weight percent maltodextrin, or less than 40 weight percent maltodextrin. In some cases, a dissolvable-chewable exhausted-tobacco tablet provided herein can include at least 20 weight percent digestion-resistant maltodextrin, at least 25 weight percent digestion-resistant maltodextrin, at least 30 weight percent digestion-resistant maltodextrin, at least 35 weight percent digestion-resistant maltodextrin, at least 40 weight percent digestion-resistant maltodextrin, at least 45 weight percent digestion-resistant maltodextrin, at least 50 weight percent digestion-resistant maltodextrin, or at least 55 weight percent digestion-resistant maltodextrin.

Sugar Alcohol(s)

Sugar alcohols, also known as polyols or polyhydric alcohols, are hydrogenated carbohydrates that can be used as sugar replacers. Sugar alcohols are non-cariogenic, low-glycemic, low-energy, low-insulinemic, low digestible, osmotic, carbohydrates that dissolve in water. Sugar alcohols can be used in comestible products to take advantage of these various properties. For example, sugar alcohols can be used to replace sugar because sugar alcohols contain fewer calories per gram than sugar and sugar alcohols do not cause tooth decay. A chewable digestible exhausted-tobacco tablet described herein can include at least one sugar alcohol combined with soluble fiber to provide a solid solution that can hold nicotine (and other optional additive) to provide a satisfying tactile and/or flavor experience.

Any suitable sugar alcohol can be used in a solid solution provided herein. Suitable sugar alcohols used in a dissolvable-chewable exhausted-tobacco tablet provided herein can be monosaccharide-derived (e.g., sorbitol, mannitol, xylitol, erythritol), disaccharide-derived (e.g., isomalt, lactitol, maltitol), or polysaccharide-derived mixtures (e.g., maltitol syrup, hydrogenated starch hydrolysates [HSH]). Sugar alcohols used in a dissolvable-chewable exhausted-tobacco tablet provided herein can be a sugar alcohol generally recognized as safe ("GRAS") or approved food additives by the Food and Drug Administration or another appropriate private, state, or national regulatory agency.

A dissolvable-chewable exhausted-tobacco tablet provided herein can include at least 20 weight percent of one or more sugar alcohols, at least 25 weight percent of one or more sugar alcohols, at least 30 weight percent of one or more sugar alcohols, at least 35 weight percent of one or more sugar alcohols, at least 40 weight percent of one or more sugar alcohols, at least 45 weight percent of one or more sugar alcohols, at least 50 weight percent of sugar alcohol, or at least 55 weight percent of one or more sugar alcohols. In some cases, a dissolvable-chewable exhausted-tobacco tablet provided herein can include less than 75 weight percent of one or more sugar alcohols, less than 60 weight percent of one or more sugar alcohols, or less than 50 weight percent of one or more sugar alcohols. In some cases, a dissolvable-chewable exhausted-tobacco tablet provided herein can include at least 2 weight percent sorbitol, at least 5 weight percent sorbitol, at least 10 weight percent sorbitol, at least 15 weight percent sorbitol, at least 20 weight percent sorbitol, at least 25 weight percent sorbitol, at least 30 weight percent sorbitol, or at least 35 weight percent sorbitol. In some cases, a dissolvable-chewable exhausted-tobacco tablet provided herein can include at least 2 weight percent mannitol, at least 5 weight percent mannitol, at least 10 weight percent mannitol, at least 15 weight percent mannitol, at least 20 weight percent mannitol, at least 25 weight percent mannitol, at least 30 weight percent mannitol, or at least 35 weight percent mannitol.

Exhausted-Tobacco Fibers

Dissolvable-chewable exhausted-tobacco tablets provided herein can include exhausted-tobacco fibers within a matrix of the solid solution. As disclosed below, the exhausted-tobacco fibers can be mixed with the soluble fiber and/or one or more sugar alcohols prior to an extrusion. Exhausted-tobacco fibers can provide passages in a matrix of the solid solution, which can permit certain additives within a tablet to be more readily accessible. The water-soluble additives can be wicked by the exhausted-tobacco fibers.

Exhausted-tobacco fibers can be derived from tobacco plant tissue. Exemplary species of tobacco include *N. rustica, N. tabacum, N. tomentosiformis*, and *N. sylvestris*. The exhausted-tobacco fibers can be obtained from any part of a tobacco plant, including the steps, leaves, or roots of a tobacco plant. The tobacco plant tissue is treated to remove at least 10 weight percent of the tobacco's soluble components, which can include alkaloids (e.g., nicotine), nitrosamines. In some embodiments, the exhausted-tobacco plant tissue can be treated to remove at least 25%, 40%, 50%, 60%, 70%, 75%, 80%, 85%, 90%, or 95%, or 99% of the tobacco's soluble components. In some embodiments, the exhausted-tobacco fibers include less than 75%, less than 50%, less than 25%, less than 10%, less than 5%, or less than 1% of the nicotine normally found in tobacco plant tissue. In some embodiments, the exhausted-tobacco fibers include less than 75%, less than 50%, less than 25%, less than 10%, less than 5%, or less than 1% of the nitrosamines normally found in tobacco plant tissue. The treatment can also remove other soluble components of the tobacco plant tissue. In some embodiments, the exhausted-tobacco can be obtained by washing tobacco plant tissue (e.g., tobacco stems) with slightly basic buffer solution. In other embodiments, the exhausted-tobacco can be obtained by treating the tobacco with supercritical fluids. For example, the exhausted-tobacco can be obtained by the processes described in U.S. Pat. No. 7,798,151, which is hereby incorporated by reference.

Before or after treatment to remove at least some of the tobacco's soluble components, the tobacco plant tissue can be treated by one or more conventional tobacco treating techniques, which may impact the flavor, aroma, color, and/or texture of the tobacco plant tissue. Some conventional tobacco treating techniques include fermentation, heat treating, enzyme treating, expanding, and curing. The exhausted-tobacco fibers can have the aroma of tobacco without contributing significantly to the components released by the exhausted-tobacco dissolvable-chewable exhausted-tobacco tablet. Desired quantities of particular components can be added the exhausted-tobacco dissolvable-chewable exhausted-tobacco tablet.

The exhausted-tobacco fibers can, in some embodiments, be prepared from plants having less than 20 μg of DVT per $cm^2$ of green leaf tissue. For example, the tobacco fibers can be selected from the tobaccos described in U.S. Patent Publication No. 2008/0209586, which is hereby incorporated by reference.

The exhausted-tobacco fibers can be processed to a desired length. In certain embodiments, the cellulosic fiber can be processed to have an average fiber length of less than 200 micrometers. In particular, embodiments, the fibers are between 25 and 125 micrometers. In other embodiments, the fibers are processed to have a an average length of 75 micrometers or less. In still other embodiments, the exhausted-tobacco fibers can be cut or shredded into widths of about 10 cuts/inch up to about 110 cuts/inch and lengths of about 0.1 inches up to about 1 inch. Exhausted-tobacco fibers can also be cut twice to have a range of fiber lengths such that about 70% of the exhausted-tobacco fibers fall between the mesh sizes of 20 mesh and 80 mesh.

The exhausted-tobacco fibers can have a total oven volatiles content of about 10% by weight or greater; about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight. As used herein, "oven volatiles" are determined by calculating the percentage of weight loss for a sample after drying the sample in a pre-warmed forced draft oven at 110° C. for 3.25 hours. The dissolvable-chewable exhausted-tobacco tablet can have a different overall oven volatiles content than the oven volatiles content of the tobacco fibers used to make the oral tobacco product. The processing steps described herein can reduce or increase the oven volatiles content.

Exhausted-tobacco fibers can also be combined with non-tobacco cellulosic fibers. Suitable sources for non-tobacco cellulosic fibers include wood pulp, cotton, sugar beets, bran, citrus pulp fiber, switch grass and other grasses, *Salix* (willow), tea, and *Populus* (poplar). In some cases, the non-tobacco cellulosic fibers can be plant tissue comprising various natural flavors, sweeteners, or active ingredients.

Additives

A variety of additives can be included in a dissolvable-chewable exhausted-tobacco tablet provided herein. The additives can include alkaloids, minerals, vitamins, dietary supplements, nutraceuticals, energizing agents, soothing agents, coloring agents, amino acids, chemsthetic agent, antioxidants, food grade emulsifiers, pH modifiers, botanicals (e.g., green tea), teeth whitening (e.g., SHMP), therapeutic agents, sweeteners, flavorants, and combinations thereof. In some cases, the additives include nicotine, sweeteners, and flavorants. With certain combinations of exhausted-tobacco, nicotine, sweeteners, and flavorants, a dissolvable-chewable exhausted-tobacco tablet provided herein may provide a flavor profile and tactile experience similar to certain tobacco products.

Nicotine

Nicotine used in dissolvable-chewable exhausted-tobacco tablet provided herein can be tobacco-derived nicotine, synthetic nicotine, or a combination thereof. In some cases, the nicotine can be liquid nicotine. Liquid nicotine can be purchased from commercial sources, whether tobacco-derived or synthetic. In some cases, a dissolvable-chewable exhausted-tobacco tablet provided herein includes between 0.1 mg and 20.0 mg of nicotine. In some cases, a dissolvable-chewable exhausted-tobacco tablet provided herein includes between 0.5 mg and 10.0 mg of nicotine. In some cases, a dissolvable-chewable exhausted-tobacco tablet provided herein includes between 1.0 mg and 6.0 mg of nicotine. In some cases, a dissolvable-chewable exhausted-tobacco tablet provided herein includes between 1.0 mg and 3.0 mg of nicotine. In some cases, nicotine can be premixed with exhausted-tobacco fibers in the method such as that described in U.S. Application No. 61/856,409, which is incorporated herein by reference, and incorporated into a chewable dissolvable exhausted-tobacco tablet provided herein.

Tobacco-derived nicotine can include one or more other tobacco organoleptic components other than nicotine. The tobacco-derived nicotine can be extracted from raw (e.g., green leaf) tobacco and/or processed tobacco. Processed tobaccos can include fermented and unfermented tobaccos, dark air-cured, dark fire cured, burley, flue cured, and cigar filler or wrapper, as well as the products from the whole leaf stemming operation. The tobacco can also be conditioned by heating, sweating, and/or pasteurizing steps as described in U.S. Publication Nos. 2004/0118422 or 2005/0178398, each of which is incorporated herein by reference. Fermenting typically is characterized by high initial moisture content, heat generation, and a 10 to 20% loss of dry weight. See, e.g., U.S. Pat. Nos. 4,528,993; 4,660,577; 4,848,373; and 5,372,149, each of which is hereby incorporated by reference. By processing the tobacco prior to extracting nicotine and other organoleptic components, the tobacco-derived nicotine may include ingredients that provide a favorable experience. The tobacco-derived nicotine can be obtained by mixing cured tobacco or cured and fermented tobacco with water or another solvent (e.g., ethanol) followed by removing the insoluble tobacco material. The tobacco extract may be further concentrated or purified. In some cases, select tobacco constituents can be removed. Nicotine can also be extracted from tobacco in the methods described in the following patents: U.S. Pat. Nos. 2,162,738; 3,139,436; 3,396,735; 4,153,063; 4,448,208; and 5,487,792, each of which is hereby incorporated by reference.

Liquid nicotine can be pure, substantially pure, or diluted prior to combination with a molten mixture of soluble fiber and one or more sugar alcohols. A diluting step is optional. In some cases, liquid nicotine is mixed with cellulosic fibers prior to adding the nicotine to a molten mixture of soluble fiber and one or more sugar alcohols.

Antioxidants

A dissolvable-chewable exhausted-tobacco tablet 110 provided herein can include one or more antioxidants. Antioxidants can result in a significant reduction in the conversion of nicotine into nicotine-N-oxide when compared to nicotine products without antioxidants. In some cases, a dissolvable-chewable exhausted-tobacco tablet provided herein can include 0.01 and 5.00 weight percent antioxidant, between 0.05 and 1.0 weight percent antioxidant, between 0.10 and 0.75 weigh percent antioxidant, or between 0.15 and 0.5 weight percent antioxidant. Suitable examples of antioxidants include ascorbyl palmitate (a vitamin C ester), BHT, ascorbic acid (Vitamin C), and sodium ascorbate (Vitamin C salt). In some cases, monosterol citrate, tocopherols, propyl gallate, tertiary butylhydroquinone (TBHQ), butylated hydroxyanisole (BHA), Vitamin E, or a derivative thereof can be used as the antioxidant. For example, ascorbyl palmitate can be the antioxidant in the formulations listed in Table I. Antioxidants can be incorporated into the solid solution during a mixing process (e.g., added to an extruder mixing the ingredients).

The nicotine can also be purchased from commercial sources, whether tobacco-derived or synthetic. In some cases, the dissolvable-chewable exhausted-tobacco tablet can include a derivative of nicotine (e.g., a salt of nicotine).

In some cases, the dissolvable-chewable exhausted-tobacco tablet 110 can have a conversion of less than 0.50% of nicotine into nicotine-N-oxide after aging the dissolvable-chewable exhausted-tobacco tablet 110 for 2 weeks at 25° C. and 65% relative humidity. In some cases, the dissolvable-chewable exhausted-tobacco tablet 110 can have a conversion of less than 0.20% of nicotine into nicotine-N-oxide after aging the dissolvable-chewable exhausted-tobacco tablet 110 for 2 weeks at 25° C. and 65% relative humidity. In some cases, the dissolvable-chewable exhausted-tobacco tablet 110 can have a conversion of less than 0.70% of nicotine into nicotine-N-oxide after aging the dissolvable-chewable exhausted-tobacco tablet 110 for 4 weeks at 25° C. and 65% relative humidity. In some cases, the dissolvable-chewable exhausted-tobacco tablet 110 can have a conversion of less than 0.30% of nicotine into nicotine-N-oxide after aging the dissolvable-chewable exhausted-tobacco tablet 110 for 4 weeks at 25° C. and 65% relative humidity. In some cases, the dissolvable-chewable exhausted-tobacco tablet 110 can have a conversion of less than 0.80% of nicotine into nicotine-N-oxide after aging the dissolvable-chewable exhausted-tobacco tablet 110 for 6 weeks at 25° C. and 65% relative humidity. In some cases, the dissolvable-chewable exhausted-tobacco tablet 110 can have a conversion of less than 0.40% of nicotine into nicotine-N-oxide after aging the dissolvable-chewable exhausted-tobacco tablet 110 for 6 weeks at 25° C. and 65% relative humidity. In some cases, the dissolvable-chewable exhausted-tobacco tablet 110 can have a conversion of less than 0.30% of nicotine into nicotine-N-oxide after aging the dissolvable-chewable exhausted-tobacco tablet 110 for 6 weeks at 25° C. and 65% relative humidity. In some cases, the dissolvable-chewable exhausted-tobacco tablet 110 can have a conversion of less than 0.85% of nicotine into nicotine-N-oxide after aging the dissolvable-chewable exhausted-tobacco tablet 110 for 8 weeks at 25° C. and 65% relative humidity. In some cases, the dissolvable-chewable exhausted-tobacco tablet 110 can have a conversion of less than 0.50% of nicotine into nicotine-N-oxide after aging the dissolvable-chewable exhausted-tobacco tablet 110 for 8 weeks at 25° C. and 65% relative humidity. In some cases, the dissolvable-chewable exhausted-tobacco tablet 110 can have a conversion of less than 0.85% of nicotine into nicotine-N-oxide after aging the dissolvable-chewable exhausted-tobacco tablet 110 for 10 weeks at 25° C. and 65% relative humidity. In some cases, the dissolvable-chewable exhausted-tobacco tablet 110 can have a conversion of less than 0.55% of nicotine into nicotine-N-oxide after aging the dissolvable-chewable exhausted-tobacco tablet 110 for 10 weeks at 25° C. and 65% relative humidity. In some cases, the dissolvable-chewable exhausted-tobacco tablet 110 can have a conversion of less than 0.95% of nicotine into nicotine-N-oxide after aging the dissolvable-chewable exhausted-tobacco tablet 110 for 12 weeks at 25° C. and 65% relative humidity. In some cases, the dissolvable-chewable exhausted-tobacco tablet 110 can have a conversion of less than 0.60% of nicotine into nicotine-N-oxide after aging the dissolvable-chewable exhausted-tobacco tablet 110 for 12 weeks at 25° C. and 65% relative humidity. In some cases, the dissolvable-chewable exhausted-tobacco tablet 110 can have a conversion of less than 1.0% of nicotine into nicotine-N-oxide after aging the dissolvable-chewable exhausted-tobacco tablet 110 for 2 weeks at 40° C. and 75% relative humidity. In some cases, the dissolvable-chewable exhausted-tobacco tablet 110 can have a conversion of less than 0.5% of nicotine into nicotine-N-oxide after aging the dissolvable-chewable exhausted-tobacco tablet 110 for 2 weeks at 40° C. and 75% relative humidity. In some cases, the dissolvable-chewable exhausted-tobacco tablet 110 can have a conversion of less than 1.4% of nicotine into nicotine-N-oxide after aging the dissolvable-chewable exhausted-tobacco tablet 110 for 4 weeks at 40° C. and 75% relative humidity. In some cases, the dissolvable-chewable exhausted-tobacco tablet 110 can have a conversion of less than 0.8% of nicotine into nicotine-N-oxide after aging the dissolvable-chewable exhausted-tobacco tablet 110 for 4 weeks at 40° C. and 75% relative humidity. In some cases, the dissolvable-chewable exhausted-tobacco tablet 110 can have a conversion of less than 1.6% of nicotine into nicotine-N-oxide after aging the dissolvable-chewable exhausted-tobacco tablet 110 for 6 weeks at 40° C. and 75% relative humidity. In some cases, the dissolvable-chewable exhausted-tobacco tablet 110 can have a conversion of less than 1.2% of nicotine into nicotine-N-oxide after aging the dissolvable-chewable exhausted-tobacco tablet 110 for 6 weeks at 40° C. and 75% relative humidity. In some cases, the dissolvable-chewable exhausted-tobacco tablet 110 can have a conversion of less than 0.9% of nicotine into nicotine-N-oxide after aging the dissolvable-chewable exhausted-tobacco tablet 110 for 6 weeks at 40° C. and 75% relative humidity. In some cases, the dissolvable-chewable exhausted-tobacco tablet 110 can have a conversion of less than 1.7% of nicotine into nicotine-N-oxide after aging the dissolvable-chewable exhausted-tobacco tablet 110 for 8 weeks at 40° C. and 75% relative humidity. In some cases, the dissolvable-chewable exhausted-tobacco tablet 110 can have a conversion of less than 1.4% of nicotine into nicotine-N-oxide after aging the dissolvable-chewable exhausted-tobacco tablet 110 for 8 weeks at 40° C. and 75% relative humidity. In some cases, the dissolvable-chewable exhausted-tobacco tablet 110 can have a conversion of less than 1.1% of nicotine into nicotine-N-oxide after aging the dissolvable-chewable exhausted-tobacco tablet 110 for 8 weeks at 40° C. and 75% relative humidity. In some cases, the dissolvable-chewable exhausted-tobacco tablet 110 can have a conversion of less than 1.8% of nicotine into nicotine-N-oxide after aging the dissolvable-chewable exhausted-tobacco tablet 110 for 10 weeks at 40° C. and 75% relative humidity. In some cases, the dissolvable-chewable exhausted-tobacco tablet 110 can have a conversion of less than 1.3% of nicotine into nicotine-N-oxide after aging the dissolvable-chewable exhausted-tobacco tablet 110 for 10 weeks at 40° C. and 75% relative humidity. In some cases, the dissolvable-chewable exhausted-tobacco tablet 110 can have a conversion of less than 1.2% of nicotine into nicotine-N-oxide after aging the dissolvable-chewable exhausted-tobacco tablet 110 for 10 weeks at 40° C. and 75% relative humidity. In some cases, the dissolvable-chewable exhausted-tobacco tablet 110 can have a conversion of less than 1.8% of nicotine into nicotine-N-oxide after aging the dissolvable-chewable exhausted-tobacco tablet 110 for 12 weeks at 40° C. and 75% relative humidity. In some cases, the dissolvable-chewable exhausted-tobacco tablet 110 can have a conversion of less than 1.7% of nicotine into nicotine-N-oxide after aging the dissolvable-chewable exhausted-tobacco tablet 110 for 12 weeks at 40° C. and 75% relative humidity. In some cases, the dissolvable-chewable exhausted-tobacco tablet 110 can have a conversion of less than 1.5% of nicotine into nicotine-N-oxide after aging the dissolvable-chewable exhausted-tobacco tablet 110 for 12 weeks at 40° C. and 75% relative humidity. The presence of antioxidants may also reduce the formation of other tobacco derived impurities, such as Cotinine and myosime.

Sweeteners

A variety of synthetic and/or natural sweeteners can be used as additives in the dissolvable-chewable exhausted-tobacco tablet 110. Suitable natural sweeteners include sugars, for example, monosaccharides, disaccharides, and/or polysaccharide sugars, and/or mixtures of two or more sugars. According to some embodiments, the dissolvable-chewable exhausted-tobacco tablet 110 includes one or more of the following: sucrose or table sugar; honey or a mixture of low molecular weight sugars not including sucrose; glucose or grape sugar or corn sugar or dextrose; molasses; corn sweetener; corn syrup or glucose syrup; fructose or fruit sugar; lactose or milk sugar; maltose or malt sugar or maltobiose; sorghum syrup; mannitol or manna sugar; sorbitol or d-sorbite or d-sobitol; fruit juice concentrate; and/or mixtures or blends of one or more of these ingredients. A dissolvable-chewable exhausted-tobacco tablet provided herein can also include non-nutritive sweeteners. Suitable non-nutritive sweeteners include: stevia, saccharin; aspartame; sucralose; or acesulfame potassium.

Flavorants

The dissolvable-chewable exhausted-tobacco tablet 110 can optionally include one or more flavorants. The flavorants can be natural or artificial. For example, suitable flavorants include wintergreen, cherry and berry type flavorants, various liqueurs and liquors (such as Dramboui, bourbon, scotch, and whiskey) spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ylang ylang, sage, fennel, pimenta, ginger, anise, chai, coriander, coffee, liquorish, and mint oils from a species of the genus *Mentha*, and encapsulated flavors. Mint oils useful in particular, embodiments of the dissolvable-chewable exhausted-tobacco tablet 110 include spearmint and peppermint. Synthetic flavorants can also be used. In some cases, a combination of flavorants can be combined to imitate a tobacco flavor. The particular combination of flavorants can be selected from flavorants that are GRAS in a particular country, such as the United States. Flavorants can also be included in the dissolvable-chewable exhausted-tobacco tablet as encapsulated flavorants.

In some cases, the flavorants in the dissolvable-chewable exhausted-tobacco tablet 110 are limited to less than 20 weight percent in sum. In some cases, the flavorants in the dissolvable-chewable exhausted-tobacco tablet 110 are limited to be less than 10 weight percent in sum. For example, certain flavorants can be included in the dissolvable-chewable exhausted-tobacco tablet 110 in amounts of about 1 weight percent to 5 weight percent.

Other Additives

Dissolvable-chewable exhausted-tobacco tablets provided herein may optionally include other. For example, these additives can further include non-nicotine alkaloids, dietary minerals, vitamins, dietary supplements, therapeutic agents, and fillers.

Dissolvable-chewable exhausted-tobacco tablets provided herein can also include vitamins, dietary minerals, other dietary supplements, and/or therapeutic agents. For example, suitable vitamins include Vitamins A, B1, B2, B6, C, D2, D3, E, F, and K. For example, a dissolvable-chewable exhausted-tobacco tablet 110 can include C-vitamins with or without the presence of nicotine. Suitable dietary minerals include calcium (as carbonate, citrate, etc.) or magnesium (as oxide, etc.), chromium (usually as picolinate), and iron (as bis-glycinate). One or more dietary minerals could be included in a dissolvable-chewable exhausted-tobacco tablet with or without the use of other additives. Other dietary supplements and/or therapeutic agents can also be included as additives.

The dissolvable-chewable exhausted-tobacco tablet provided herein can also include fillers such as starch, dicalcium phosphate, lactose, sorbitol, mannitol, and microcrystalline cellulose, calcium carbonate, dicalcium phosphate, calcium sulfate, clays, silica, sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides), stabilizers (e.g., ascorbic acid and monosterol citrate, BHT, or BHA), disintegrating agents (e.g., starch, sodium starch glycolate, cross caramellose, cross linked PVP), pH stabilizers, or preservatives. In some cases, an amount of filler in the dissolvable-chewable exhausted-tobacco tablet 110 is limited to less than 10 weight percent in sum. In some cases, an amount of filler in the dissolvable-chewable exhausted-tobacco tablet 110 is limited to be less than 5 weight percent in sum. In some cases, fillers can dissolve or disintegrate during use and thus result in a dissolvable-chewable exhausted-tobacco tablet that becomes more pliable during use.

Plasticizers

Dissolvable-chewable exhausted-tobacco tablets provided herein can also include one or more plasticizers. Plasticizers can soften the final dissolvable-chewable exhausted-tobacco tablet and thus increase its flexibility. Suitable plasticizers include propylene glycol, glycerin, vegetable oil, partially hydrogenated oil, triglycerides, triacetin, medium chain triglycerides, and combinations thereof. In some cases, the plasticizer can include phthalates. Esters of polycarboxylic acids with linear or branched aliphatic alcohols of moderate chain length can also be used as plasticizers. Moreover, plasticizers can facilitate the extrusion processes described below. In some cases, the dissolvable-chewable exhausted-tobacco tablet 110 can include up to 20 weight percent plasticizer. In some cases, a dissolvable-chewable exhausted-tobacco tablet provided herein includes between 0.05 and 10 weight percent plasticizer, between 1 and 8 weight percent plasticizer, or between 2 and 4 weight percent plasticizer. For example, a dissolvable-chewable exhausted-tobacco tablet provided herein can include about 3 to 6.5 weight percent of propylene glycol.

Molding Processes

Dissolvable-chewable exhausted-tobacco tablets provided herein can be produced by forming a molten mixture of soluble fiber, sugar alcohols (e.g., sorbitol and mannitol), exhausted-tobacco, and optionally one or more additives (e.g., nicotine or derivatives thereof) and shaping that molten mixture into individual dissolvable-chewable exhausted-tobacco tablets. The molten mixture is formed under controlled heating conditions such that a solution of soluble fiber, sugar alcohol(s), water, and exhausted-tobacco is formed without degrading the exhausted-tobacco or creating cross-linking between the sugar alcohol(s) and/or the soluble fiber. In some cases, a temperature of the molten mixture is maintained at a temperature below 150° C. In some cases, a rod or sheet of the molten mixture is extruded and cut into individual dissolvable-chewable exhausted-tobacco tablets. In some cases, a molten mixture of soluble fiber, sugar alcohol(s), and nicotine can be injection molded, compression molded, or injection-compression molded.

Cooking processes forming dissolvable edible products sometimes utilize the cross-linking of sugars or sugar alcohols that occurs after heating to caramelization temperatures. Such heating results in a desirable caramelization of the product. The relatively high temperatures required for caramelization, however, can accelerate the degradation of exhausted-tobacco because of the high temperatures and other factors (e.g., residence time during extrusion). Because exhausted-tobacco degradation can be accelerated when exposed to elevated temperatures over extended periods of time, the temperature of a molten mixture provided herein can be maintained at a temperature of 150° C. or below over a processing time (e.g., a residence time of five to ten minutes or less if an extrusion process is utilized). In some cases, a molten mixture provided herein is heated to a temperature of between 80° C. and 200° C. In some cases, a molten mixture provided herein is heated to a temperature of between 100° C. and 110° C. When cooled below its glass transition temperature, a molten mixture provided herein solidifies into an amorphous, non-porous, soluble fiber matrix containing exhausted-nicotine. A solid solution of tobacco and sugar alcohol(s), however, can provide a dissolvable exhausted-tobacco tablet provided herein with a suitable dissolution time when place in an adult consumer's mouth. A dissolvable tobacco tablet provided herein can also be chewable.

Figure 2:
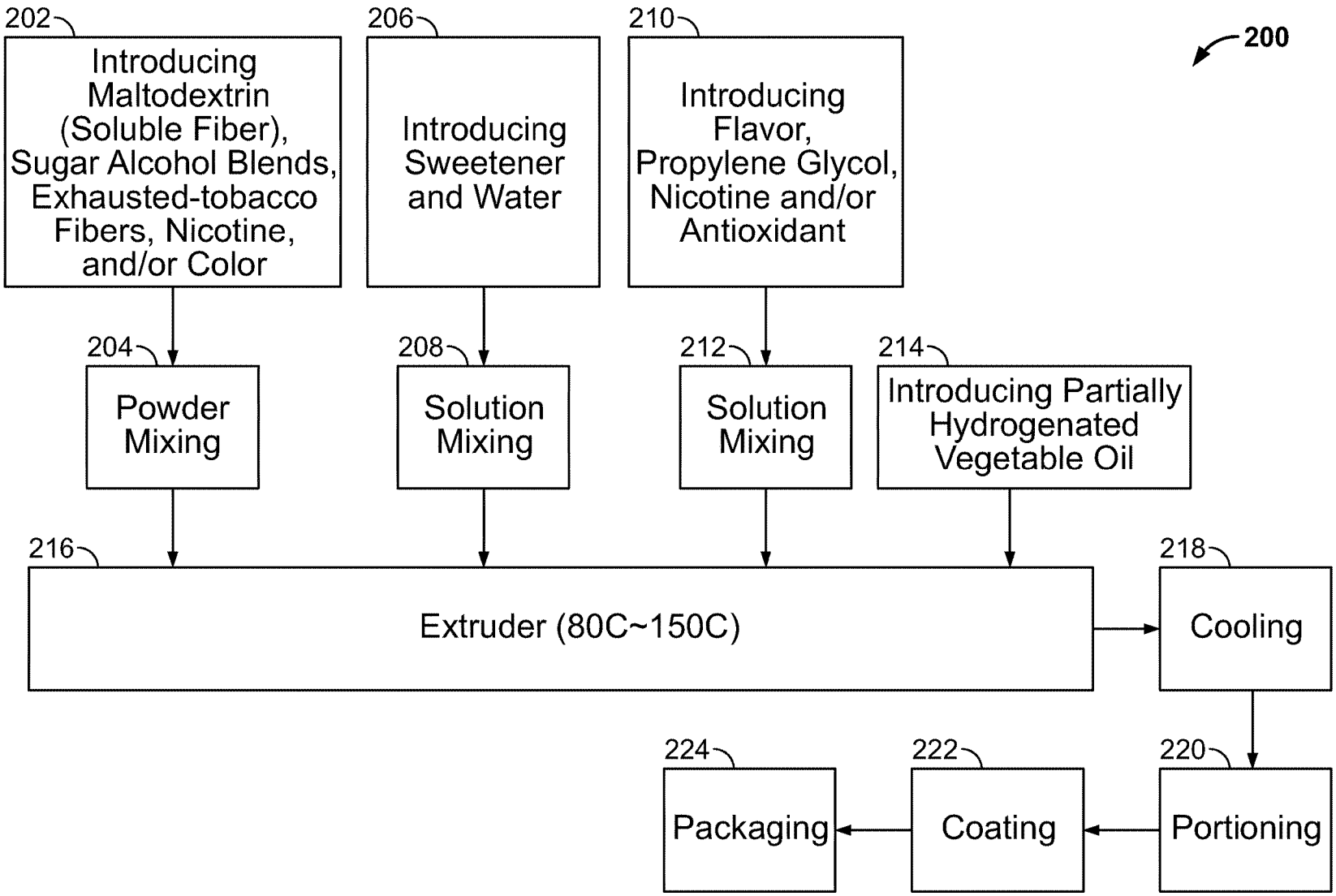
FIG. 2 is a process diagram for making dissolvable-chewable exhausted-tobacco tablets according to a method provided herein.

A molten mixture can be mixed and heated in any suitable but controlled method. In some cases, such as shown in FIG. 2, ingredients for a molten mixture can be combined in an extruder and mixed in a continuous extrusion process. Unlike a traditional cooking method, dissolvable-chewable exhausted-tobacco tablet provided herein can have attributes precisely controlled by extruder operation parameters, such as feed rate, barrel temperature profile, screw design, rpms, etc.

Water added to molten mixture can be maintained at a percentage of less than 15 weight percent. A water content of a dissolvable-chewable exhausted-tobacco tablet provided herein can be controlled in the extrusion process to ensure that the molten mixture becomes a solid solution. In some cases, a molten mixture can have a water content of less than 15 weight percent. In some cases, water content in a dissolvable-chewable exhausted-tobacco tablet provided herein ranges from 0.5 weight percent to 7 weight percent. In some cases, water content in a dissolvable-chewable exhausted-tobacco tablet provided herein ranges from 1 weight percent to 5 weight percent.

Referring to the extrusion process 200 illustrated in FIG. 2, exhausted-tobacco fibers, soluble fibers (e.g., maltodextrin or digestion resistant maltodextrin), sugar alcohol or blend of multiple sugar alcohols (e.g., sorbitol and mannitol), cellulose insoluble fibers, nicotine or derivatives thereof, and color (e.g., $TiO_2$) can be introduced 202 into the extrusion process 200 and can undergo a powder mixing 204 for a period of time before progressing to the extruder 216. A mixing extruder 216 can include multiple stages controlled to be maintained at a predetermined temperature. As shown, extruder 216 can include stages having temperatures ranging between 80° C. and 150° C. For example, an extruder can have seven stages with each stage controlled to a specific temperature (e.g., some stages range between 80° C. and 100° C., from 100° C. and 110° C., from 100° C. and 110° C., from 100° C. and 150° C., from 100° C. and 150° C., from 100° C. and 150° C., from 80° C. and 120° C.). A mixture of sweetener and water can also be introduced 206 into the process 200 and can undergo a solution mixing step 208 for a period of time before progressing to the extruder 216. Any combination of nicotine, flavor, propylene glycol, and antioxidants can also be introduced 210 into the process 200 and can undergo a solution mixing step 212 for a period of time before progressing to the extruder 216. In some cases, this process allows exhausted-tobacco and one or more additives (e.g., nicotine or derivatives thereof) to be incorporated into the process with minimum exposure to temperature and air. A plasticizer (e.g., partially hydrogenated vegetable oil) can also undergo a solution mixing step 214 for a period of time before progressing into the extruder 216. The extruder 216 can maintain a warm internal temperature (e.g., between approximately 80° C. to 150° C.). The low temperature of the extruder 216 has the advantage of reducing undesirable degradation of additives (e.g., nicotine) and cross-linking of the sugar alcohol(s). The molten mixture can exit the extruder 216 and be allowed to cool (e.g., to ambient temperature) to form a viscous material including a solid solution of soluble fiber and sugar alcohol(s), which is then cut in a portioning process 220 to form individual dissolvable-chewable exhausted-tobacco tablets. Portioning process 220 can include a process of rounding the edges of the dissolvable-chewable exhausted-tobacco tablets. For example, a pelletizer can be used to round the edges. After portioning, the dissolvable-chewable exhausted-tobacco tablets can undergo a coating process 222 and a packaging process 224, each of which is discussed above.

In addition to extrusion, there are other methods for mixing and carefully controlling the temperature of a molten mixture used to form dissolvable-chewable exhausted-tobacco tablets provided herein.

Other Embodiments

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

What is claimed is:

1. A dissolvable-chewable exhausted-tobacco tablet comprising:

oral-soluble maltodextrin fibers in an amount of from 55 weight percent to 70 weight percent by weight of the tablet;

sugar alcohols in an amount of from 20 weight percent to 40 weight percent by weight of the tablet, wherein the sugar alcohols are selected from the group consisting of mannitol, sorbitol, xylitol, erythritol, isomalt, lactitol, maltitol, maltitol syrup, hydrogenated starch hydrolysates, and combinations thereof, and wherein the tablet is free of cross-linkages between sugar alcohols and/or between the sugar alcohols and the oral-soluble maltodextrin fibers;

exhausted-tobacco fibers in an amount of from 0.5 weight percent to 10 weight percent by weight of the tablet, wherein the exhausted-tobacco fibers have an average fiber length ranging from 75 micrometers to 125 micrometers;

plasticizers in an amount of from 0.05 weight percent to 10 weight percent by weight of the tablet, wherein the plasticizers are selected from the group consisting of propylene glycol, glycerin, triglycerides, and combinations thereof, and wherein the oral-soluble maltodextrin fibers, the sugar alcohols, the exhausted-tobacco fibers, and the plasticizers define a first domain in the tablet; and oils in an amount of from 2 weight percent to 15 weight percent by weight of the tablet, wherein the oils are selected from the group consisting of hydrogenated oil, palm kernel oil, coconut oil, corn oil, cotton seed oil, olive oil, peanut oil, canola oil, sesame oil, soybean oil, rapeseed oil, safflower oil, sunflower oil, mustard oil, almond oil, beech nut oil, cashew oil, hazelnut oil, macadamia oil, pecan oil, pine nut oil, pistachio oil, walnut oil, grapefruit seed oil, lemon oil, orange oil, pumpkin oil, watermelon seed oil, citrus oils, oils from melons and gourd seeds, flaxseed oil, cocoa butter, and combinations thereof, wherein the oils define a plurality of second domains dispersed in the first domain, and wherein the tablet takes up to 4 hours to dissolve when placed in an adult consumer's mouth and takes between 1 minute and 30 minutes to dissolve when chewed by the adult consumer.

2. A dissolvable-chewable exhausted-tobacco tablet comprising:

oral-soluble maltodextrin fibers in an amount of from about 55 weight percent to 70 weight percent by weight of the tablet;

sugar alcohols in an amount of from 20 weight percent to 40 weight percent by weight of the tablet, wherein the sugar alcohols are selected from the group consisting of mannitol, sorbitol, xylitol, erythritol, isomalt, lactitol, maltitol, maltitol syrup, hydrogenated starch hydrolysates, and any combinations thereof, and wherein the tablet is free of cross-linkages between the sugar alcohols and/or between the sugar alcohols and the oral-soluble maltodextrin fibers;

exhausted-tobacco fibers in an amount of from 0.5 weight percent to 10 weight percent by weight of the tablet, wherein the exhausted-tobacco fibers have an average fiber length ranging from about 75 micrometers to about 125 micrometers;

plasticizers in an amount of from 0.05 weight percent to 10 weight percent by weight of the tablet, wherein the plasticizers are selected from the group consisting of propylene glycol, glycerin, triglycerides, and combinations thereof, and wherein the oral-soluble maltodextrin fibers, the sugar alcohols, the exhausted-tobacco fibers, and the plasticizers define a first domain in the tablet; and oils in an amount of from 2 weight percent to 15 weight percent by weight of the tablet, wherein the oils are selected from the group consisting of hydrogenated oil, palm kernel oil, coconut oil, corn oil, cotton seed oil, olive oil, peanut oil, canola oil, sesame oil, soybean oil, rapeseed oil, safflower oil, sunflower oil, mustard oil, almond oil, beech nut oil, cashew oil, hazelnut oil, macadamia oil, pecan oil, pine nut oil, pistachio oil, walnut oil, grapefruit seed oil, lemon oil, orange oil, pumpkin oil, watermelon seed oil, citrus oils, oils from melons and gourd seeds, flaxseed oil, cocoa butter, and combinations thereof, wherein the oils define a plurality of second domains dispersed in the first domain, and wherein the tablet takes up to 4 hours to dissolve when placed in an adult consumer's mouth and takes between 1 minute and 30 minutes to dissolve when chewed by the adult consumer.

3. The tablet of claim 1, wherein the tablet further comprises nicotine in an amount of from 0.1 mg to 20 mg by weight of the tablet, wherein the nicotine is dispersed with the oral-soluble maltodextrin fibers, the sugar alcohols, the exhausted-tobacco fibers, and the plasticizer in the first domain.

4. The tablet of claim 3, wherein the nicotine comprises synthetic nicotine.

5. The tablet of claim 3, wherein the nicotine comprises tobacco-derived nicotine.

6. The tablet of claim 1, wherein the tablet further comprises an antioxidant in an amount of from 0.01 weight percent to 5 weight percent by weight of the tablet, wherein the antioxidant is dispersed with the oral-soluble maltodextrin fibers, the sugar alcohols, the exhausted-tobacco fibers, and the plasticizer in the first domain.

7. The tablet of claim 1, wherein the tablet further comprises water in an amount of from 0.5 weight percent to 7 weight percent by weight of the tablet, wherein the water is dispersed with the oral-soluble maltodextrin fibers, the sugar alcohols, the exhausted-tobacco fibers, and the plasticizer in the first domain.

8. The tablet of claim 1, wherein the tablet is shield shaped.

9. The tablet of claim 1, wherein the tablet is part of a sheet structure configured for subdivision into individual tablets.

10. A method of forming the tablet of claim 1 wherein, the method comprises:

(a) forming a molten mixture by combining oral-soluble maltodextrin fibers, sugar alcohols, exhausted-tobacco fibers, plasticizers, oils, and water at a mixture temperature of less than 150° C., wherein the molten mixture includes the oral-soluble maltodextrin fibers in an amount of from 55 weight percent to 70 weight percent by weight of the molten mixture;

the sugar alcohols in an amount of from 20 weight percent to 40 weight percent by weight of the molten mixture, wherein the sugar alcohols are selected from the group consisting of mannitol, sorbitol, xylitol, erythritol, isomalt, lactitol, maltitol, maltitol syrup, hydrogenated starch hydrolysates, and any combinations thereof;

the exhausted-tobacco fibers in an amount of from 0.5 weight percent to 10 weight percent by weight of the molten mixture, wherein an average fiber length of the exhausted-tobacco fibers ranges from 75 micrometers to 125 micrometers;

the plasticizers in an amount of from 0.05 weight percent to 10 weight percent by weight of the molten mixture, wherein the plasticizer is selected from the group consisting of propylene glycol, glycerin, triglycerides, and combinations thereof; and the oils in an amount of from 2 weight percent to 15 weight percent by weight of the tablet, wherein the oils are selected from the group consisting of hydrogenated oil, palm kernel oil, coconut oil, corn oil, cotton seed oil, olive oil, peanut oil, canola oil, sesame oil, soybean oil, rapeseed oil, safflower oil, sunflower oil, mustard oil, almond oil, beech nut oil, cashew oil, hazelnut oil, macadamia oil, pecan oil, pine nut oil, pistachio oil, walnut oil, grapefruit seed oil, lemon oil, orange oil, pumpkin oil, watermelon seed oil, citrus oils, oils from melons and gourd seeds, flaxseed oil, cocoa butter, and combinations thereof;

the water in an amount of less than 15 weight percent of the molten mixture, (b) cooling the molten mixture to form a cooled mixture, wherein the cooled mixture defines a first domain including the oral-soluble maltodextrin fiber, the sugar alcohols, the exhausted-tobacco fiber, and the plasticizer, and a plurality of second domains that are dispersed in the first domain; and (c) portioning the cooled mixture into a plurality of dissolvable-chewable exhausted-tobacco tablets, wherein each tablet is free of cross-linkages between the sugar alcohols and/or between the sugar alcohols and the oral-soluble maltodextrin fibers.

11. The method of claim 10, wherein the method further comprises:

applying a coating to each dissolvable-chewable exhausted-tobacco tablet of the plurality of dissolvable-chewable exhausted-tobacco tablets, wherein the coating comprises a material selected from the group consisting of carnuba wax, beeswax, zein, acetylated monoglyceride, a hydroxypropylated potato starch, and any combination thereof.

12. The method of claim 10, wherein the method further comprises:

applying a coating to each dissolvable-chewable exhausted-tobacco tablet of the plurality of dissolvable-chewable exhausted-tobacco, wherein the coating comprises a material selected from the group consisting of methylcellulose, hydroxypropyl methylcellulose, carboxymethyl cellulose, ethyl cellulose, gelatin, and any combination thereof.

* * * * *